US007500324B1

(12) United States Patent
Power et al.

(10) Patent No.: US 7,500,324 B1
(45) Date of Patent: Mar. 10, 2009

(54) CONVERTIBLE THERAPEUTIC SANDALS

(76) Inventors: Kyle Power, 74 Tower St., Methuen, MA (US) 01844-4424; John Power, 74 Tower St., Methuen, MA (US) 01844-4424; Patty Power, 74 Tower St., Methuen, MA (US) 01844-4424

( * ) Notice: Subject to any disclaimer, the term of this patent is extended or adjusted under 35 U.S.C. 154(b) by 145 days.

(21) Appl. No.: 11/291,637

(22) Filed: Nov. 30, 2005

(51) Int. Cl.
*A43B 5/00* (2006.01)
*A63B 23/08* (2006.01)

(52) U.S. Cl. ..... 36/132; 36/7.5; 36/15; 482/79

(58) Field of Classification Search ..... 36/132, 36/7.5, 25 R, 15; 482/79, 80
See application file for complete search history.

(56) References Cited

U.S. PATENT DOCUMENTS

| | | | | | |
|---|---|---|---|---|---|
| 887,752 | A * | 5/1908 | Beck et al. | 36/7.5 |
| 1,437,376 | A * | 11/1922 | Young | 36/7.6 |
| 2,096,500 | A * | 10/1937 | McCahan et al. | 36/114 |
| 3,538,628 | A * | 11/1970 | Einstein, Jr. | 36/15 |
| 3,982,336 | A * | 9/1976 | Herro | 36/62 |
| 4,247,996 | A * | 2/1981 | Grapin et al. | 36/103 |
| 4,499,674 | A * | 2/1985 | Olivieri | 36/117.3 |
| 4,821,432 | A * | 4/1989 | Reiber | 36/110 |
| 5,070,867 | A * | 12/1991 | March | 36/145 |
| 5,533,278 | A * | 7/1996 | Stein | 36/11.5 |
| 6,176,817 | B1 | 1/2001 | Carey et al. | |
| 6,311,416 | B1 * | 11/2001 | Cohen | 36/136 |
| 6,421,935 | B1 * | 7/2002 | Bartlett | 36/132 |
| 6,792,703 | B2 * | 9/2004 | Cohen | 36/136 |
| 6,821,235 | B1 * | 11/2004 | Johnson et al. | 482/79 |
| 7,266,912 | B2 * | 9/2007 | Whatley | 36/132 |
| 7,278,227 | B2 * | 10/2007 | Masoodifar | 36/114 |
| 2001/0042325 | A1 * | 11/2001 | Cohen | 36/136 |
| 2002/0026730 | A1 * | 3/2002 | Whatley | 36/132 |
| 2002/0059739 | A1 * | 5/2002 | Cohen | 36/142 |
| 2004/0242382 | A1 * | 12/2004 | Gibas et al. | 482/79 |
| 2005/0160625 | A1 * | 7/2005 | Whatley | 36/25 R |

* cited by examiner

*Primary Examiner*—Marie Patterson
(74) *Attorney, Agent, or Firm*—Russ Weinzimmer

(57) ABSTRACT

A therapeutic sandal is provided that includes an upper component having a front strap assembly and a rear strap assembly for securing a foot to the upper component, and a lower component, cooperative with the upper component, having at least one fulcrum object attached to the bottom surface of the lower component. The lower component is replaceable with another lower component with at least one different fulcrum object attached thereto. The lower component has at least one or two compressible fulcrum objects thereto. The lower component can also have at least one substantially non-compressible fulcrum object attached to the bottom surface. The invention provides a means for effectively exercising different muscle groups of the legs. The therapeutic sandals can be advantageously used by young children, in part due to the element of novelty and fun provided by wearing and using them, thereby encouraging a child to continue their use.

16 Claims, 4 Drawing Sheets

CONVERTIBLE THERAPEUTIC SANDALS

FIELD OF THE INVENTION

This invention relates generally to physical therapy, and particularly to wearable physical therapeutic devices.

BACKGROUND OF THE INVENTION

Weakness in the ankles, calves, and thighs may be due to disease, accident, or immobility, for example. Strengthening the muscle groups in the ankles, calves, and/or thighs can often require extensive physical therapy, typically involving expensive machines and/or other apparatus designed to exercise a specific area of musculature. Moreover, there are few devices presently available that adequately address the needs of young children in this regard.

One effective method for improving muscle strength in the lower legs and ankles is to induce unstable footing for the patient, requiring him/her to compensate through increased muscle tension to achieve and maintain balance. Numerous attempts have been made to provide unstable foundations that are safe and effective in stressing certain muscle groups in the lower extremities. One such example is the apparatus taught in U.S. Pat. No. 6,176,817. However, such a device is large, heavy, takes up substantial floor space, and is expensive. Further, it is not readily portable, allows no walking, and works both legs together, not individually.

Joint Stability Training is an essential part of most physical re-habilitation programs. Joint stability is a condition whereby a joint remains or promptly returns to proper alignment through equalization of muscular forces. Lower extremity joint stability is dependent mostly on the contractile strength of muscles of the legs. Thus, appropriate muscular strength training can provide an increased level of joint stability. Standing and walking on an unstable surface requires the ability to dynamically adjust muscle contractions so as to stabilize the joints. The need to maintain or recover one's balance frequently provides repeated stimulation to the muscles which will, over time, promote the neuromuscular development needed to stabilize the joints.

Some physical therapists have recommended putting pillows and/or other soft objects on the floor, and then walking on them while attempting to maintain balance and joint stability. Such an exercise can also add an additional muscular challenge beyond just walking on an open floor area. In this way, a physical therapeutic effect can be achieved. This may be practical in dedicated facilities where a space is intended for the physical therapy of patients. However, if physical therapy must be performed in a home environment, it is sometimes impractical to dedicate a substantial area of the home to this purpose. If the area must be used for purposes other than the therapy, it is time-consuming and inconvenient to set up the space with the pillows and/or other soft objects, and then further time-consuming and inconvenient to return the space to it's normal purpose.

SUMMARY OF THE INVENTION

In one general aspect of the invention, a therapeutic sandal is provided that includes an upper component having a front strap assembly and a rear strap assembly for securing a foot to the upper component, and a lower component, cooperative with the upper component, the lower component having a bottom surface, and having at least one fulcrum object attached to the bottom surface.

In a preferred embodiment, the lower component attaching to the upper component via a slidable interlocking mechanism. In a further preferred embodiment, the slidable interlocking mechanism is of a dovetail shape. In a yet further preferred embodiment, the dovetail shape is formed into both the upper component and the lower component such that a snug interconnection if formed therebetween.

In another embodiment, the front strap assembly includes a strap and a D-ring. In a further embodiment, the strap is covered with Velcro™ hooks over a first portion, and is covered with Velcro™ loops over a second portion. In still another embodiment, the strap is looped through the D-ring so as to secure the strap in place.

In another preferred embodiment, the rear strap assembly includes an instep strap and a heel strap. In a further preferred embodiment, the rear strap assembly further includes two D-rings.

In a preferred embodiment, the lower component is replaceable with another lower component with at least one different fulcrum object attached thereto.

In a further embodiment, the lower component has at least one compressible fulcrum object attached to the bottom surface. In an alternate preferred embodiment, the lower component has at least two compressible fulcrum objects attached to the bottom surface. In still a further preferred embodiment, the lower component has at least one substantially non-compressible fulcrum object attached to the bottom surface.

In a still further preferred embodiment, the lower component has a fulcrum object attached to the bottom surface substantially in a middle of the bottom surface. In yet another preferred embodiment, the lower component has two fulcrum objects, one attached to the bottom surface substantially under a heel of a user, and one attached to the bottom surface substantially under a set of toes of the user.

In another general aspect of the invention, a therapeutic sandal includes an upper component having a front strap assembly and a rear strap assembly for securing a foot to the upper component, the front strap assembly including a strap and a D-ring, and the rear strap assembly including an instep strap and a heel strap, as well as a lower component, cooperative with the upper component, the lower component having a bottom surface, and having at least one fulcrum object attached to the bottom surface, the lower component attaching to the upper component via a slidable interlocking mechanism.

In a further embodiment, the slidable interlocking mechanism is of a dovetail shape, the dovetail shape being formed into both the upper component and the lower component such that a snug interconnection if formed therebetween.

In another preferred embodiment, the lower component is replaceable with another lower component with at least one different fulcrum object attached thereto. In a further preferred embodiment, the lower component has at least one compressible fulcrum object attached thereto. In yet another preferred embodiment, the lower component has at least one substantially non-compressible fulcrum object attached thereto.

The invention provides a means for effectively exercising different muscle groups of the legs, thereby strengthening them. By using various versions of the lower component of the therapeutic sandal of the invention, a user can work different muscle groups in either by standing or walking.

The therapeutic sandals of the invention are small, light in weight, work while either standing or walking, and exercise the muscles of both legs and ankles. The therapeutic sandals of the invention can be provided in a range of sizes, from toddler to adult, and are relatively inexpensive.

The therapeutic sandals of the invention can be used by young children. The invention is particularly suited for this type of user due to the element of novelty and fun provided by wearing and using the invention, thereby encouraging a child to continue its use, greatly improving the opportunity for successful therapy. Since the invention permits both walking and standing, the invention facilitates improvement of the child's balance skills, as well as strengthening the legs for walking.

BRIEF DESCRIPTION OF THE DRAWING

The invention will be more fully understood by reference to the detailed description, in conjunction with the following figures, wherein.

DETAILED DESCRIPTION OF THE DRAWINGS

Figure 1:
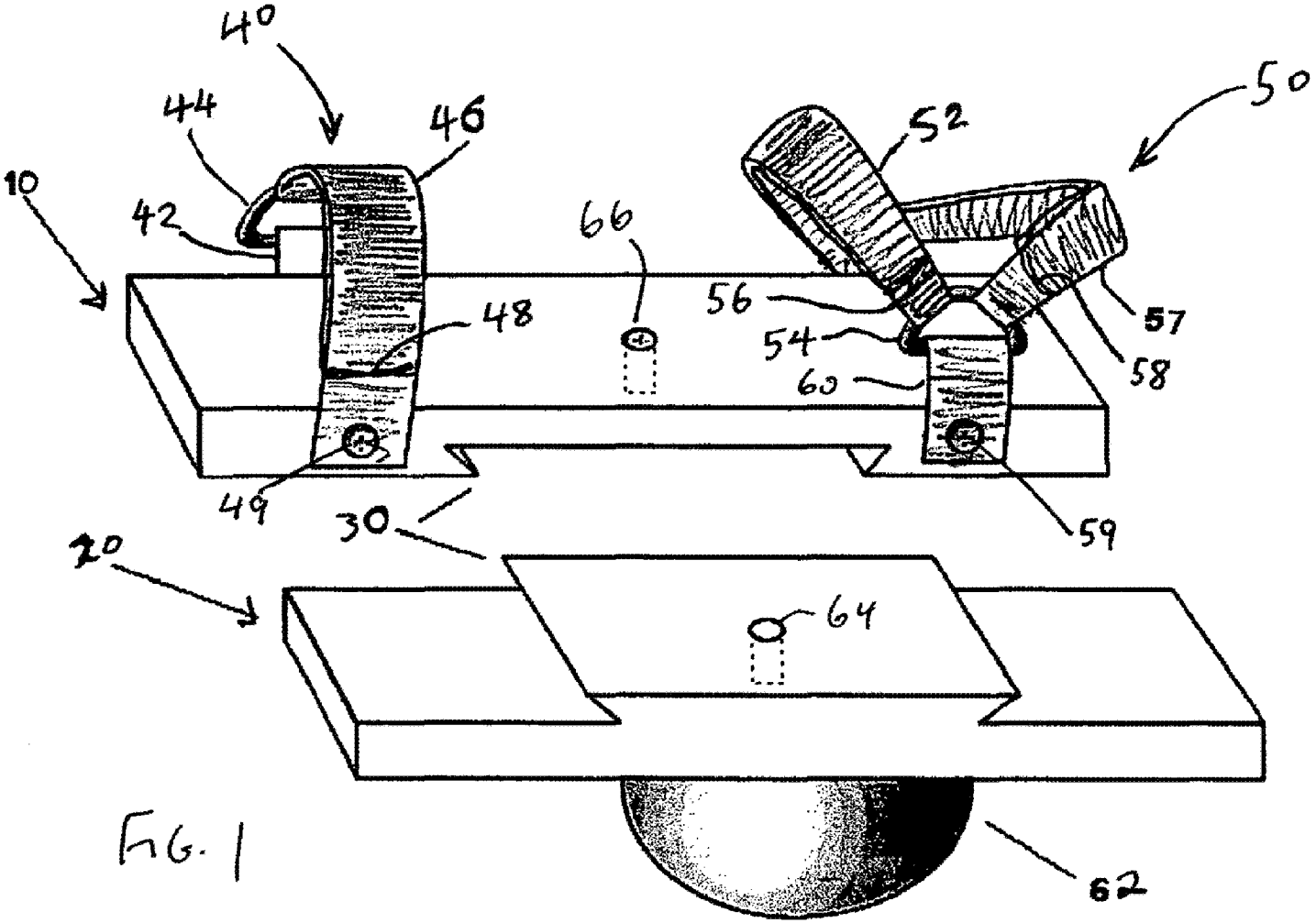
FIG. 1 is an exploded perspective view showing the upper and lower components of the therapeutic sandal of the invention, including an embodiment of the upper component which attaches to a user's foot with adjustable straps, and an embodiment of the lower component which connects to the upper component via a sliding dovetail joint and locking screw.

Referring to FIG. 1, the upper component 10 is sized and shaped so as to accommodate a foot either wearing or not wearing a shoe, a sneaker, or any other footwear. Consequently, the therapeutic sandal of the invention can come in many sizes to accommodate a size or range of foot and/or footwear sizes. One therapeutic sandal is worn on each foot. The sandals would typically be associated as pairs, and worn as a pair. The pair preferably has mirror symmetry, such that there's a right sandal and a left sandal in each pair.

In a preferred embodiment, shown in FIG. 1, the upper component 10 of one sandal of a pair of sandals is rectangular in shape to accommodate a foot wearing an athletic shoe. The dimensions of the upper component 10, both length and width, will depend upon the size of the wearer's foot. Thus, the therapeutic sandal of the invention will be offered in various sizes.

The lower component 20 is sized similarly to the upper component 10, so that they may be conjoined via the dovetail joint 30, or other tongue and groove joint, or complementary sloted arrangement.

The upper and lower components 10, 20 can be made from a variety of materials, such as wood, plastic, composite, or metal (such as aluminum). If made of wood, the wood can be a hard wood such as maple, or some synthetic substitute.

The user's foot is affixed to the upper component 10 using a front strap assembly 40 and a rear strap assembly 50. The front strap assembly 40 includes a short strap 42 attached at one end to the upper component 10 and terminating in a D-ring 44, and a long strap 46 that is attached at one end to the upper component 10, looped through the D-ring 44, and folded back upon itself. The long strap 46 bears VELCRO™ material on the side of the strap 46 that folds back upon itself, so the VELCRO™ cannot be seen in FIG. 1.

The VELCRO™ material includes "hooks" material over half its length, and "loops" material over the other half of its length, such that when the long strap 46 bearing the VELCRO™ material is threaded through the D-ring and folded over the foot, the loops can mate with the hooks, thereby retaining the shoe/foot in the therapeutic sandal of the invention. The front of the foot can be released by pulling up on the end 48 of the long strap 46, thereby separating all the hooks from the loops of the VELCRO™ material.

An end of the short strap 42 is attached to the far side (not shown in this view) of the upper component 10 with a fastener, such as a screw or rivet. Also, an end of the long strap 46 is attached to the near side of the upper component 10 with a fastener 49, such as a screw or a rivet.

The long strap 46 and the short strap 42 are each made of a woven material, or durable plastic, or flexible leather, for example. Any substantially non-stretchable material would work, so that the foot/shoe can be firmly affixed to the upper component 10 of the therapeutic sandal of the invention.

The rear strap assembly 50 includes an instep strap 52 attached at one end to a D-ring 54, and looped through a second D-ring (not shown) so as to fold back upon itself to secure the foot to the upper component 10. The instep strap 52 bears VELCRO™ material on the side of the strap 52 that folds back upon itself, so the VELCRO™ cannot be seen in FIG. 1. The instep strap 52 can be released by lifting the end 56 so as to separate the hook material from the loop material, thereby also helping to release the foot/shoe from the upper component 10.

The rear strap assembly 50 also includes a heel strap 57 attached at one end to the D-ring 54, extending behind the heel of the shoe, and looped through the second D-ring (not shown) so as to fold back upon itself to secure the foot against backward movement relative to the upper component 10. The heel strap 57 bears VELCRO™ material on the side of the strap 57 that folds back upon itself, so the VELCRO™ cannot be seen in FIG. 1. The heel strap 57 can be released by lifting the end 58 so as to separate the hook material from the loop material of the VELCRO™, thereby also helping to release the foot/shoe from the upper component 10.

The D-ring 54 is attached via a D-ring strap 60 to the near side of the upper component 10 with a fastener 59, such as a screw or a rivet.

The lower component 20 is preferably made of the same material as the upper component 10. Attached to the lower component is a fulcrum object 62, such as a compressible ball. A screw 66 can optionally be impelled into the hole 64 to ensure that the upper component 10 is not able to separate from the lower component 20 during use.

Figure 2:
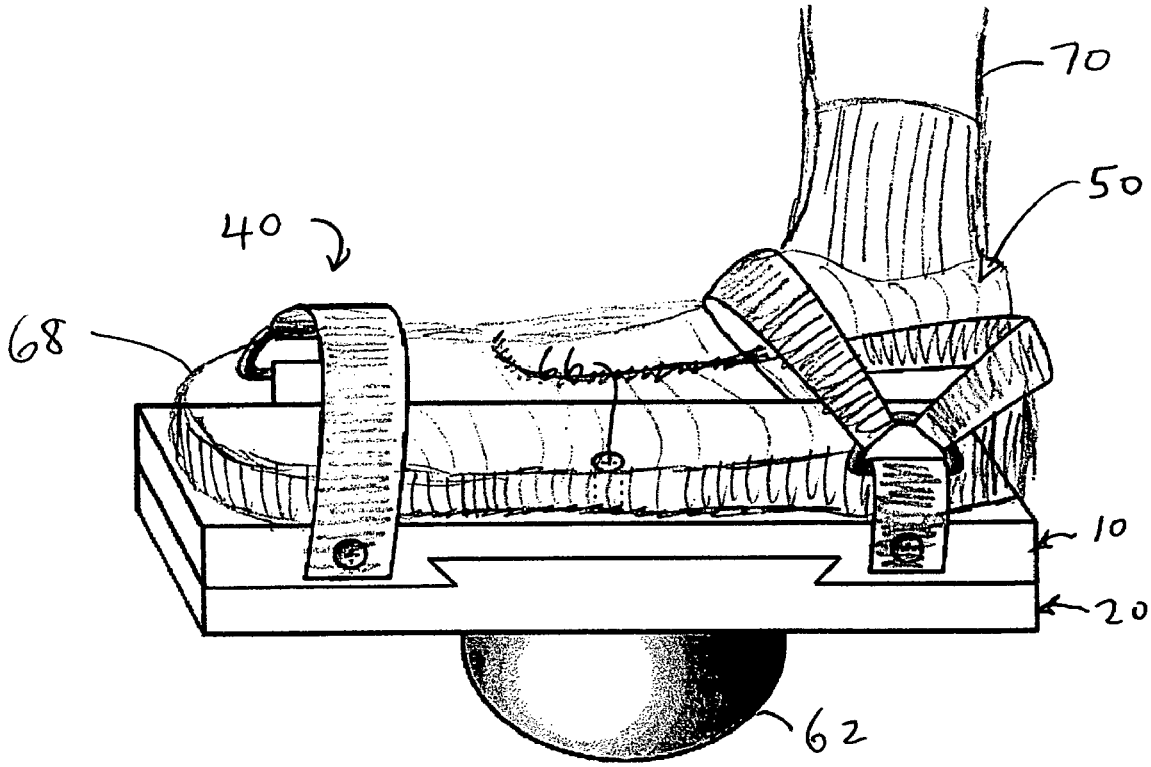
FIG. 2 is a perspective view showing the upper component of FIG. 1 mated with the lower component of FIG. 1, connected via the sliding dovetail joint and locking screw, also showing a ghosted image of a shoe of a user, the shoe being securely strapped into the therapeutic sandal with the adjustable straps of FIG. 1.

FIG. 2 shows a therapeutic sandal of the invention wherein the upper component 10 is mated with the lower component 20, and secured with the screw 66. In this view, a ghosted image of a shoe 68 of a user 70 is shown, the shoe 68 being strapped to the upper component 10 using the front strap assembly 40 and the rear strap assembly 50. The shoe 68 is strapped tightly such that it is securely fastened to the upper component 10.

A compressible fulcrum object 62 allows a relatively small range of motion for some combination of lateral rocking motion (roll), and forward/backward rocking motion (pitch), i.e., some combination of pitch and roll. Compressible fulcrum objects include tennis balls, or balls with similar properties. Tennis balls, or any ball with a fuzzy surface, will also allow a twisting or side-to-side motion (yaw). Foam rubber balls can also be used as compressible fulcrum objects. Foam rubber balls, or any ball with a non-slippery surface, will tend to inhibit side-to-side or twisting motion (yaw) of the therapeutic sandal of the invention. Ideally, the compressible fulcrum object will return to its original shape after weight is removed from the lower component 20.

A substantially non-compressible fulcrum object allows a relatively large range of motion for some combination of lateral motion, and forward/backward motion. Substantially non-compressible fulcrum objects include baseballs, or balls with similar properties. Such balls have a soft coating, but are essentially hard, and therefore do not substantially compress when bearing weight.

Figure 3:
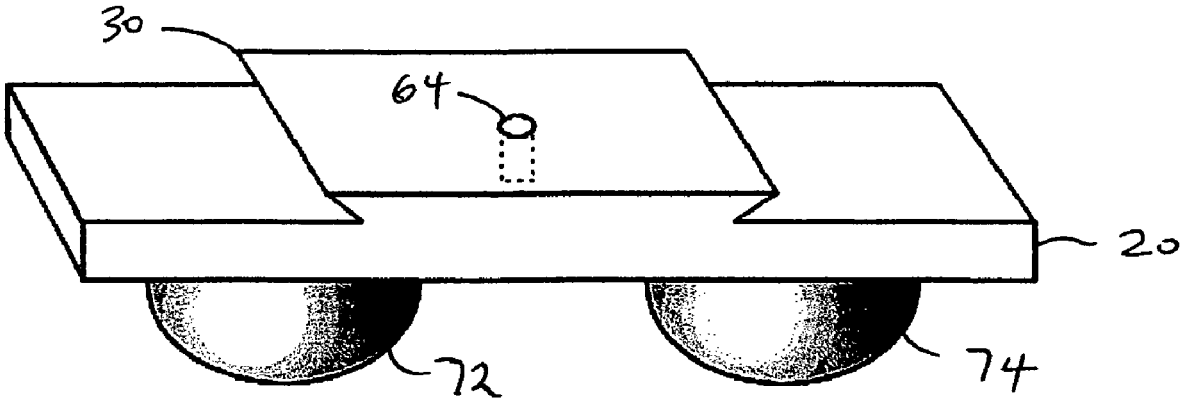
FIG. 3 shows an alternate embodiment of the lower component having two balls.

Referring to FIG. 3, in some preferred embodiments, more than one fulcrum object is attached to the lower component 20 of a sandal. For example, when there are two compressible fulcrum objects 72, 74, the range of motion for forward and backward rocking (pitch) is less than the range of motion (pitch) possible for a single compressible fulcrum object. The range of motion for lateral rocking motion (roll) for two compressible fulcrum objects will be the same range of motion (roll) as for one compressible fulcrum object.

Note that the compressible fulcrum objects 72, 74 are attached in the middle of the area under where the toe of the shoe 68 would be located, and in the middle of the area where the heel of the shoe would be located, when the shoe is strapped into the therapeutic sandal of the invention.

Figure 4:
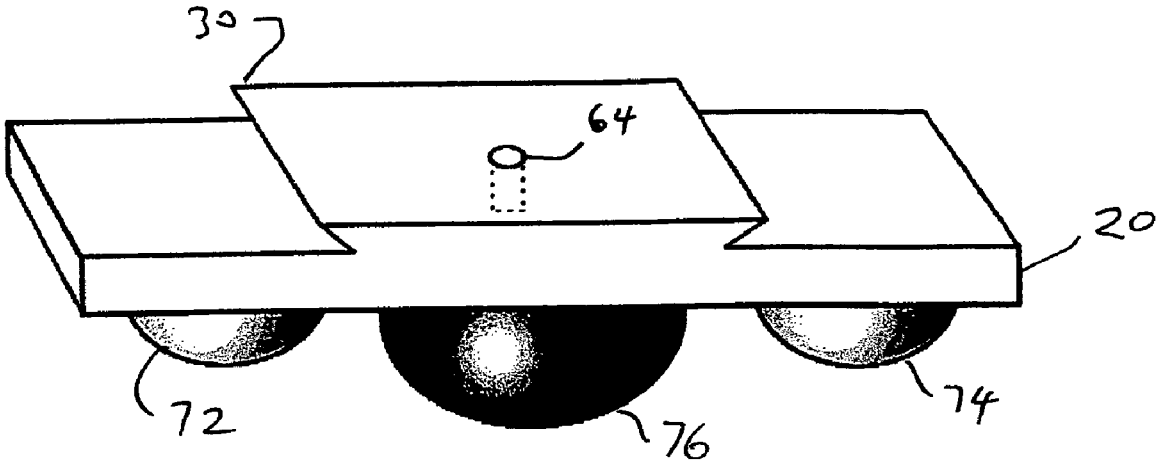
FIG. 4 shows another embodiment of the lower component having three balls, the central ball being harder than the two other balls.

With reference to FIG. 4, the bottom component 20 has two compressible fulcrum objects 72, 74, and one substantially non-compressible fulcrum object 76 attached thereto. Note that the substantially non-compressible fulcrum object 76 is located between the two compressible fulcrum objects 72, 74. Also notice that all the fulcrum objects 72, 74, 76 are arranged in an "in-line" configuration along a mid-line axis of the therapeutic sandal of the invention.

In the embodiment of FIG. 4, a more extensive lateral range of motion (roll) is possible than with just one or two compressible fulcrum objects, since the substantially non-compressible fulcrum object is harder than the compressible fulcrum objects, and therefore acts more like a perfect fulcrum.

Also, the range of motion for the forward/backward rocking motion (pitch) is more extensive for the embodiment of FIG. 4, than for either the single compressible fulcrum object of FIGS. 1 and 2, or for the double compressible fulcrum objects of FIG. 3. This is true, even though the compressible fulcrum objects 72, 74 limit the range of motion in both the pitch and roll degrees of freedom. In a preferred embodiment, the substantially non-compressible fulcrum object 76 is larger than each of the compressible fulcrum objects 72, 74.

The underlying principal of the physical therapy applied using the invention is that of increasing the range of motion possible by use of the fulcrum objects, and combinations thereof. In response to the increased range of motion possible, the muscles of the user are challenged to control the stabilization of the foot. Consequently, neuromuscular learning, and muscle strengthening occur. Stabilization is needed to maintain balance throughout a walking motion. The muscles of the ankle, calf, shin, and thigh alternately come into play depending upon which embodiment of the lower component 20 is used.

The single large ball 62 shown in FIGS. 1 and 2 helps to strengthen ankle, calf (Gastronemus), and thigh muscles. This embodiment provides a good challenge to balance that helps increases general balance in the lower as well as the upper body.

The two smaller balls 72 and 74 shown in FIG. 3 help to strengthen the outer and inner calf muscles, as well as the ankle muscles. This is done by a side-to-side rocking motion (roll). As the user rocks side-to-side, it helps to build stronger ankles, as well as stronger shin (Tibalis anterior) muscle, and calf (Gastronemus) muscle.

The three balls 72, 74, and 76 together help to strengthen shin muscles (Tibalis anterior), and calf muscles (Gastronemus) as the user rocks heel-to-toe or toe-to-heel. As the toe goes downward (Plantar extension-flexion), the shin muscles extend and the calf muscles contract. Then when the user rocks backwards (Extension or Dorsiflexion), he/she contracts the shin muscles and extends the calf muscles, thereby strengthening the lower leg muscles.

It is a significant feature and advantage of the invention that the embodiments of the lower component 20 FIGS. 2, 3, and 4 may all be used with the upper component 10 to provide different challenges and experiences to the user. Of course, other embodiments of the lower component 20 can be created that nevertheless fall within the scope of the invention, providing yet more variety. For example, many different sized and shaped fulcrum objects can be used, each having many possible degrees of compressibility. In this way, the therapeutic benefits can be customized and adjusted to the individual needs of each user.

Other modifications and implementations will occur to those skilled in the art without departing from the spirit and the scope of the invention as claimed. Accordingly, the above description is not intended to limit the invention except as indicated in the following claims.

What is claimed is:

1. A therapeutic sandal comprising:

an upper component having a front strap assembly and a rear strap assembly for securing a foot to the upper component;

a lower component having a bottom surface, and having at least one compressible fulcrum object attached to the bottom surface, the lower component being attachable to the upper component so as to place the fulcrum object in a fixed location relative to the upper component; and a replacement lower component, the lower component being replaceable by the replaceable lower component, the replacement lower component differing from the lower component according to at least one of the location, shape, and compressibility of a fulcrum object attached thereto.

2. The therapeutic sandal of claim 1, the lower component being attachable to the upper component via a slidable interlocking mechanism.

3. The therapeutic sandal of claim 2, wherein the slidable interlocking mechanism is of a dovetail shape.

4. The therapeutic sandal of claim 3, wherein the dovetail shape is formed into both the upper component and the lower component such that a snug interconnection is formed therebetween.

5. The therapeutic sandal of claim 1, wherein the front strap assembly includes a front strap and a front D-ring.

6. The therapeutic sandal of claim 5, wherein the front strap is covered with hook fastening material over a first portion, and is covered with loop fastening material over a second portion.

7. The therapeutic sandal of claim 5, wherein the front strap is looped through the front D-ring so as to secure the strap in place.

8. The therapeutic sandal of claim 1, wherein the rear strap assembly includes an instep strap and a heel strap.

9. The therapeutic sandal of claim 8, wherein the rear strap assembly further includes two D-rings.

10. The therapeutic sandal of claim 1, wherein the lower component has at least two compressible fulcrum objects attached to the bottom surface.

11. The therapeutic sandal of claim 1, wherein the lower component has at least one substantially non-compressible fulcrum object attached to the bottom surface.

12. The therapeutic sandal of claim 1, wherein the lower component has a fulcrum object attached to the bottom surface substantially in a middle of the bottom surface.

13. The therapeutic sandal of claim 1, wherein the lower component has two fulcrum objects, one attached to the bottom surface substantially under a heel of a user, and one attached to the bottom surface substantially under a set of toes of the user.

14. A therapeutic sandal comprising:

an upper component having a front strap assembly and a rear strap assembly for securing a foot to the upper component, the front strap assembly including a strap and a D-ring, and the rear strap assembly including an instep strap and a heel strap;

a lower component, cooperative with the upper component, the lower component having a bottom surface, and having at least one compressible fulcrum object attached to the bottom surface, the lower component being attachable to the upper component via a slidable interlocking mechanism so as to place the fulcrum object in a fixed location relative to the upper component; and a replacement lower component, the lower component being replaceable by the replacement lower component, the replacement lower component differing from the lower component according to at least one of the location, shape, and compressibility of a fulcrum object attached thereto.

15. The therapeutic sandal of claim 14, wherein the slidable interlocking mechanism is of a dovetail shape, the dovetail shape being formed into both the upper component and the lower component such that a snug interconnection is formed therebetween.

16. The therapeutic sandal of claim 14, wherein the lower component has at least one substantially non-compressible fulcrum object attached thereto.

* * * * *